US008245373B2

(12) United States Patent
Haussler et al.

(10) Patent No.: US 8,245,373 B2
(45) Date of Patent: Aug. 21, 2012

(54) NEEDLE HOLDER FOR A TEXTILE MACHINE

(75) Inventors: Hans Haussler, Oporto (PT); Gustav Wizemann, Messstetten-Hossingen (DE); Christian Gerth, Albstadt (DE); Reinhold Eydner, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 170 days.

(21) Appl. No.: 12/705,154

(22) Filed: Feb. 12, 2010

(65) Prior Publication Data

US 2011/0041303 A1 Feb. 24, 2011

(30) Foreign Application Priority Data

Feb. 12, 2009 (EP) ..... 09152726

(51) Int. Cl.
*D04H 18/00* (2012.01)

(52) U.S. Cl. ..... 28/115

(58) Field of Classification Search ..... 28/107, 28/115, 108–114; 112/80.01, 80.15, 80.4, 112/80.45

See application file for complete search history.

(56) References Cited

U.S. PATENT DOCUMENTS

| | | | | |
|---|---|---|---|---|
| 2,349,086 | A * | 5/1944 | Foster | 28/115 |
| 3,122,815 | A | 3/1964 | Smith | |
| 3,309,753 | A | 3/1967 | Astor | |
| 3,388,443 | A * | 6/1968 | O'Byrne | 28/115 |
| 3,397,436 | A | 8/1968 | Zocher | |
| 3,774,273 | A | 11/1973 | Okamoto et al. | |
| 3,877,120 | A * | 4/1975 | Okamoto et al. | 28/115 |
| 3,913,189 | A | 10/1975 | Foster | |
| 4,035,881 | A * | 7/1977 | Zocher | 28/111 |
| 4,037,297 | A * | 7/1977 | Foster | 28/115 |
| 4,131,978 | A | 1/1979 | Zocher | |
| 4,540,108 | A * | 9/1985 | Campbell | 223/102 |
| 4,937,924 | A * | 7/1990 | Leuchtenmuller | 28/107 |
| 5,035,033 | A | 7/1991 | Leuchtenmuller | |
| 6,444,292 | B1 | 9/2002 | Legl | |
| 2010/0162543 | A1 * | 7/2010 | Dilo | 28/115 |

FOREIGN PATENT DOCUMENTS

| | | |
|---|---|---|
| CH | 343353 | 12/1959 |
| DE | 1435765 | 1/1969 |
| DE | 2108115 | 9/1971 |
| DE | 3105358 | 9/1982 |
| DE | 10005261 | 8/2000 |
| DE | 20203158 | 7/2003 |
| GB | 399104 | 9/1933 |
| GB | 2228497 | 8/1990 |

OTHER PUBLICATIONS

Derwent-ACC-No. 1982-76831E, English language abstract of DE 3105358, Sep. 9, 1982, 2 pages.*
Pub-No. DE003105358A1, English language abstract of DE 3105358, Sep. 9, 1982, 2 pages.*

* cited by examiner

*Primary Examiner* — Amy Vanatta
(74) *Attorney, Agent, or Firm* — Fitch, Even, Tabin & Flannery, LLP

(57) ABSTRACT

A needle holder 45 for a textile machine comprising a needle board (46), in which are provided—on an upper side (44)—several grooves (48) extending parallel to each other. Arranged along each groove (48), there are several bores (51) at a distance from each other and completely extending through the needle board (46). The diameter (E) of the bores (51) is greater than a mean value of the groove width (B) or greater than the groove width (B) in the region of the groove base (70)

15 Claims, 5 Drawing Sheets

NEEDLE HOLDER FOR A TEXTILE MACHINE

CROSS-REFERENCE TO RELATED APPLICATION

The present application claims the priority of European Patent Application No. 09 152 726.7, filed Feb. 12, 2009, the subject matter of which, in its entirety, is incorporated herein by reference.

BACKGROUND OF THE INVENTION

The invention relates to a needle holder for a textile machine with a needle board. Such a needle holder is disposed to accommodate needles, for example felting needles of fork needles, and can be used in textile machines such as, e.g., felting machines. A needle holder with a needle board has been known, for example, from document DE 31 05 358 A1. The grooves provided in the grooved board have a cross-section in the form of a swallow tail, whereby the groove width—viewed transversely with respect to the direction of extension of the grooves—is smaller in the region of the upper side of the needle board than the diameter of a foot part of a needle that extends into the groove when the needle is in operative position. This is to prevent the needle from accidentally falling out of the needle board.

Considering this, it is the object of the present invention to provide a needle board of a needle holder, said board allowing a high needle density.

SUMMARY OF THE INVENTION

The above object generally is achieved according to the present invention by a needle holder displaying the features of patent claim 1. In operative position of the needles, said needles are inserted in the bores of the needle board and are thus supported in place transversely with respect to the central axis of the bores. The needle foot that is arranged on one end of the needles comprises a holding means, said foot—with the needle inserted in the needle board—projecting into the groove that extends through the respective bore. The holding means ensures that the needle is securely held in the needle board. Said foot is disposed to hold the needle in the needle board in the direction of said needle's longitudinal axis and in the direction of the central axis of the bore, and is disposed to specify the rotational position of the needle about its longitudinal axis. Referring to the needle holder in accordance with the invention, a high needle density is achieved in that the diameter of the bores that accommodates a region of the needle shank is greater than a mean value of the groove width or greater than the groove width in the region of the groove base. As a result of this it is possible to arrange the grooves more closely next to each other, without impairing the stability of the groove strips remaining between the grooves in the needle board.

Advantageous embodiments of the needle holder result from the dependent patent claims.

The bores of two adjacent grooves may be arranged—viewed in the direction of extension of the grooves—so as to be offset relative to each other. In so doing, the central axes of the bores—viewed in the direction of extension of the grooves—are arranged so as to be at a distance relative to each other. As a result of this, it is possible to arrange adjacent grooves even more closely next to each other. In addition, it is possible to achieve the desired puncture patterns in the textile material that is to be processed.

It is advantageous if a groove distance in groove width direction in a direction transverse to the direction of extension of the grooves has a maximum width between the groove center of one of the grooves and the groove center of one of the directly adjacent grooves that has a dimension that is at most as large as the diameter of the bores. A further increase of the needle density can be achieved with this arrangement.

Furthermore, it is possible to improve the stability of the strip between two grooves of the needle board by suitably selecting the cross-sectional form of the grooves. In so doing, it may be practical if the grooves have a cross-sectional form that is different from the rectangular form. For example, the groove width may increase starting from the groove base to the upper side of the needle board, as a result of which the base of the strip between two flanks delimiting a groove is widened.

The support of the holding means of the needles in the grooves can be improved when an edge is formed at the groove base in the direction of extension of the groove and the surfaces of the groove base or the groove flanks adjoining the edge extend in a direction diagonal to the central axis of the bores. As a result of this, it is possible to compensate for tolerances between the holding means and the groove. Furthermore, it is possible to provide a trapeze-shaped, triangle-shaped or U-shaped contoured cross-section for the grooves. Such cross-sectional forms can be produced in a cost-effective manner with commercially available tools. In particular, the needle board consists of a non-elastic material, preferably of metal. The grooves may be imparted by appropriately milling the upper side of the needle board.

A needle that is particularly suitable for use in the needle holder has, along a longitudinal axis, a working section which is coaxially adjoined by a lower and an upper shank section, whereby, adjoining the upper shank section, there is an adjoining needle foot with a holding means extending in a transverse direction transversely to the longitudinal axis of the needle in an essentially straight manner. The holding means may extend in a direction away from the longitudinal axis of the needle. In special applications, it is advantageous if the holding means extends away from the longitudinal axis of the needle toward two opposing sides. The holding means has its own longitudinal central axis, said axis representing the normal of the longitudinal central axis of the needle. The diameter of the upper shank section is greater than the diameter of the lower shank section and is also greater than the mean value of the width of the holding means. The width of the holding means is defined in the direction of the normal, the longitudinal central axis of the holding means, and defines a width direction.

Additional details of embodiments of the invention result from the description, the drawings or the claims. The description is restricted to essential details of the embodiments of the invention and miscellaneous situations. The drawings disclose additional details and are to be used as reference.

SUMMARY OF THE INVENTION

Figure 1:
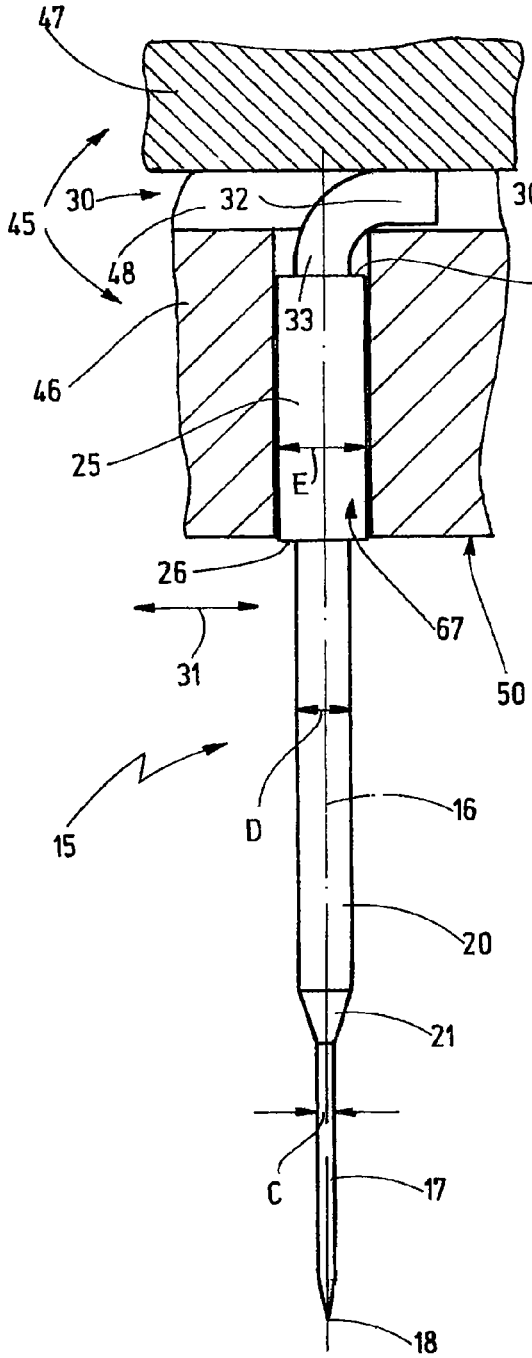
FIG. 1 is a schematic side view of a first exemplary embodiment of a needle in operative position, inserted in a needle holder.
Figure 2:
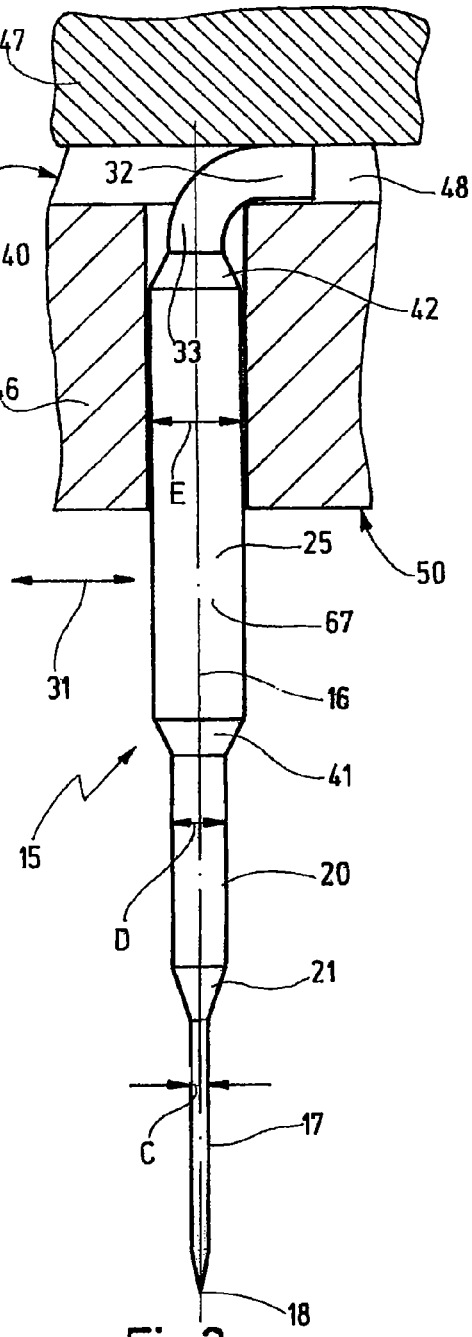
FIG. 2 is the same view of a modification of the exemplary embodiment of the needle in accordance with FIG. 1.

FIGS. 1 and 2 are schematic illustrations of a needle 15 for use in a textile machine. The needle 15 is a felting needle or fork needle for a felting machine, for example. The needle 15 is shown in its operative position in which it is supported in a needle holder 45 of the felting machine, said felting machine comprising a needle board 46 and a needle bar 47.

The needle 15 has a working section 17 extending along a longitudinal axis 16, whereby the needle point 18 is arranged on said working section. The needle point 18 represents the first free end 19 of the needle 15.

Adjoining the working section 17 is a lower shank section 20 that extends coaxially with respect to the longitudinal axis and coaxially with respect to the working section 17. The lower shank section 20 has a circular cross-section with a diameter D that is greater than the diameter C of the working section 17. The diameter of a shank section 20 or the working section 17 of the needle 15 corresponds to the smallest-possible diameter of a lateral cylinder surface of a circular cylinder, said lateral cylinder surface being arranged coaxially with respect to the longitudinal axis 16 and completely circumscribing the respective shank section. In so doing, no part of the respective section extend through the lateral cylinder surface. Due to the different diameters of the working section 17 and the lower shank section 20, these two sections 17, 20 are connected to each other via a conical first transition region 21, said transition region continuously widening from the working section 17 to the lower shank section 20.

The outside surface of the first transition region 21, in the example, corresponds to the lateral surface of a truncated cone. Considering a modification thereof, the transition region 21 could also be configured without edges. In addition, it is possible to provide reinforcement ribs on the first transition region 21 in order to increase the flexural strength of the needle in this region.

Referring to the exemplary embodiment described here, the cross-section of the lower shank section 20 is circular. Its diameter D corresponds to the diameter of a needle blank that is used to produce the needle 15.

Adjoining the lower shank section 20, the needle 15 has a larger shank section 25 with a diameter E that is greater than the diameter D of the lower shank section 20. The cross-section of the upper shank section 25 may be circular; however, different therefrom, any other cross-sectional configuration is possible, such as, for example as shown by FIGS. 8*a* through 8*f*. Considering the exemplary embodiment in accordance with FIG. 1, a step 26 is provided between the lower shank section 20 and the upper shank section 25, said step forming an annular surface extending coaxially with respect to the longitudinal axis 16. Alternatively, the transition in the exemplary embodiment shown by FIG. 2 is implemented by the second transition region 41 that widens conically from the lower shank section 20 toward the upper shank section 25. The second transition region 41 may be configured analogously to the first transition region 21.

Adjoining the upper shank section 25, is a needle foot 30 that comprises a holding means 32 that extends essentially in a straight line. This holding means 32 extends along a transverse direction 31 that is arranged transversely with respect to the longitudinal axis 16 of the needle 15.

Referring to the exemplary embodiments in accordance with FIGS. 1 and 2, the holding means 32 is connected with the upper shank section 25 via a curved foot connection 33 of the needle foot 30. Alternatively, the holding means 32 may also be directly connected with the upper shank section 25, as is obvious, for example, from FIGS. 6*a* and 6*b*. Referring to the needles 15 shown in FIGS. 1 and 2, the cross-section of the foot connection 33 and the holding means 32 corresponds to the cross-section of the lower shank section 20. Consequently, it is possible to shape the needle foot 30 of the needle 15 by bending the foot connection 33 from a needle blank. Considering a modification thereof, at least the holding means 32 of the needle foot 30 may also have a cross-section that is different from the circular form, whereby cross-sectional forms are shown as examples by FIGS. 7*a* through 7*f*.

The width of the holding means 32 is measured in a width direction 34 transversely to the longitudinal axis 16 and transversely to the transverse direction 31. The mean value of the width of the holding means 32 of the needle 15 is smaller than the diameter E of the upper shank section 25. Referring to the needle in FIG. 1, a second step 40 is provided between the foot connection 33 and the upper shank section 25, said second step forming an annular surface that is coaxial with respect to the longitudinal axis 16. Different therefrom, The needle shown by FIG. 2 has a third transition region 42 with a diameter that continuously decreases from the upper shank region 25 to the foot connection 33. This third transition region 42 may also be configured in a manner corresponding to the first and the section transition regions 21, 41.

Figure 6A:
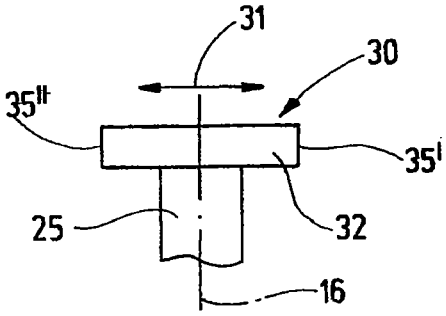
FIGS. 6*a* and 6*b* are schematic views of a modified embodiment of the needle foot of the needle in a side view (FIG. 6*a*) and in a front view (FIG. 6*b*).
Figure 6B:
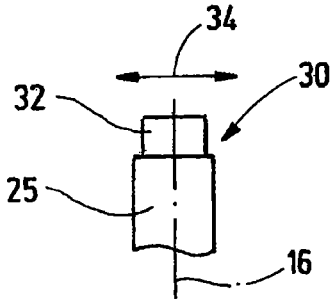

Referring to the needle 15 in accordance with FIGS. 1 and 2, the upper shank section 25 and the needle foot 30 form an L-shaped holding region of the needle, in which said needle is supported on the needle holder 45. Different therefrom, this holding region in the modified embodiment of the needle 15 in accordance with FIGS. 6*a* and 6*b* is T-shaped. In this case, the holding means 32 is seated directly on the upper shank section 25 and extends from the longitudinal axis 16 in two opposing directions beyond the upper shank section 25. The holding means 32 extends in a straight line from a first free end 35' through the longitudinal axis 16 up to a second free end 35".

The needle foot 30 in accordance with FIGS. 6*a* and 6*b* is shaped from a needle blank, for example, by pulling, pushing or pressure-type reshaping. In so doing, the holding means 32 may be imparted with any cross-sectional form other than the cross-sectional form of the needle blank. Considering the preferred embodiment, the needle foot 30 has a form that is symmetrical with respect to a plane of symmetry, said plane extending through the longitudinal axis 16 and the width direction 34.

A few possible cross-sectional forms for the holding means 32 are shown in FIGS. 7*a* through 7*f*.

Figure 7A:
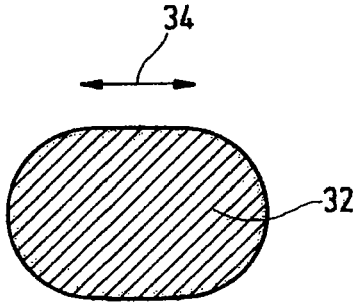
FIGS. 7*a* through 7*f* are various cross-sectional forms of the holding means of the needle foot.
Figure 7B:
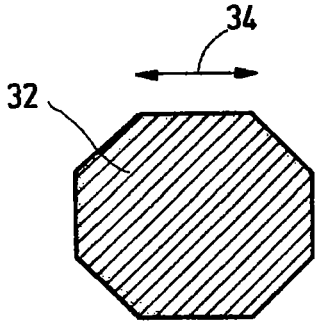
Figure 7C:
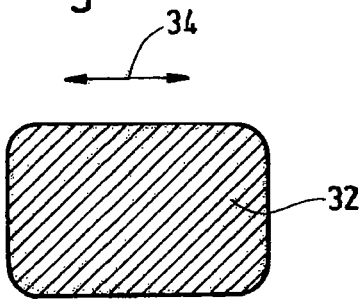
Figure 7D:
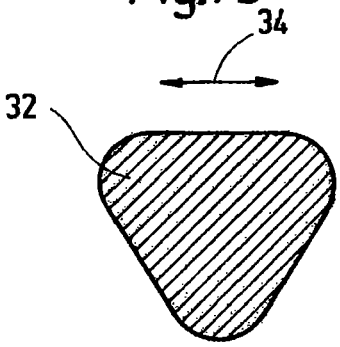
Figure 7E:
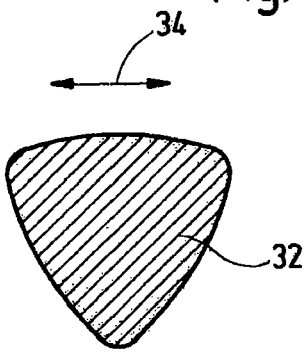
Figure 7F:
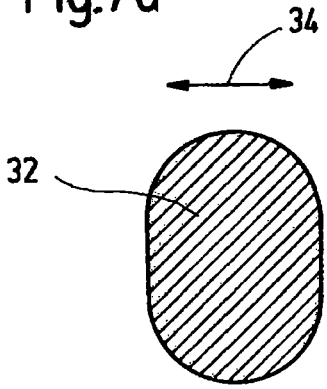

The mean value of the width and, in particular, the width of the holding means 32, is smaller at any point in the width direction 34 than the diameter E of the upper shank section 25. The cross-section of the holding means 32 may be oval (the form of a race-track) or ellipse-like. Considering the exemplary embodiment in accordance with FIG. 7*b*, the cross-section of the holding means 32 is configured as a polygon and, in accordance with the example, as a regular octagon. The corners of such a polygon may also be round, for example be provided with a radius, as is obvious from the example of a rectangle shown in FIG. 7*c*. Considering the two exemplary embodiments in accordance with FIGS. 7*d* and 7*e*, the cross-section of the holding means 32 has a triangle-like shape. As in the case of FIG. 7*c*, the triangle-like cross-sectional configurations in accordance with FIG. 7*d* are provided with radii. The radii in the corner regions of the cross-section of FIG. 7*e* are clearly smaller than in the case of the embodiment of the modification in accordance with FIG. 7*d*. Different from FIG. 7*d*, the sides of the triangle bulge outward in the triangle-like cross-section in accordance with FIG. 7*e*.

Possible cross-sectional forms of the upper shank section 25 are shown as examples in FIGS. 8*a* through 8*f*. As a result of this cross-sectional form that is different from the circular cross-sectional form, the abutment sites 60 are formed distributed over the circumference of the upper shank section 25, said abutment sites being located on a common lateral cylinder surface 61 about the longitudinal axis 16. If the upper shank section 25 is twisted about the longitudinal axis 16 of the needle in the form of a spiral (not illustrated), the abutment sites 60 follow this spiral along the lateral cylinder surface 61 of the shank section 25. The diameter of this lateral cylinder surface 61 corresponds to the diameter E of the upper shank section 25. Considering the preferred exemplary embodiments of the cross-sectional forms of the upper shank section 25, the abutment sites 60 are regularly distributed—viewed in circumferential direction, whereby said abutment sites are arranged parallel to the longitudinal axis 16 of the needle. The number of abutment sites 60 and their form is a function of the selected contour of the cross-section. If the abutment sites 60 are arranged over a larger area on the lateral cylinder surface 61, two opposing abutment sites 60 may be sufficient. Preferably, three, four or also more abutment sites 60 are provided in a regular manner distributed over the circumference on the outside surface 67 of the upper shank section 25. The diameter of the lateral cylinder surface 61, on which the abutment sites 60 are arranged, corresponds approximately to the diameter of the bores 51 in the needle board 46. Therefore, the abutment sites 60 represent the surface areas of the upper shank section 25 that are disposed to abut against the inside surface 56 of the bore 51, said bore—as it were—representing a counter abutment surface 56 for the abutment sites 60.

A recess 65 is provided between each two abutment sites 60. The radial distance of the outside surface region of the upper shank section 25 is smaller—everywhere in the region of a recess 65—between two abutment sites 60 that at the abutment site 60. Consequently, abutment sites 60 are found only on the common lateral cylinder surface 61.

Figure 8A:
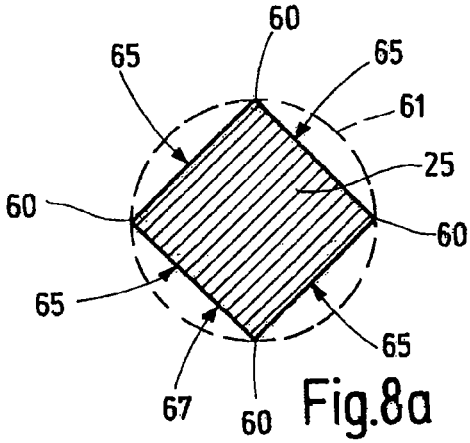
FIGS. 8*a* through 8*f* are various cross-sectional forms of the upper shank section of the needle.

The upper shank section 25 may have, for example, a polygonal, in particular rectangular or, as shown in FIG. 8*a*, a square cross-section. Each corner of the polygon has the same distance from the longitudinal axis 16 of the needle, so that longitudinal edges extending along the upper shank section 25 in longitudinal direction along the longitudinal axis 16 form longitudinal abutment sites 60.

Figure 8B:
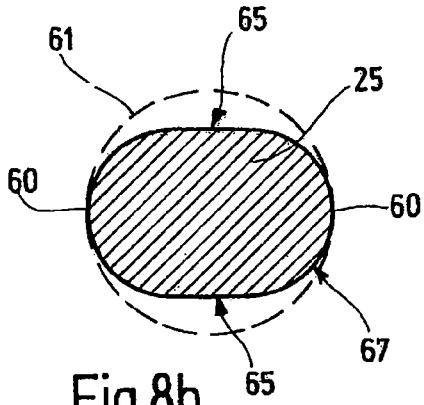

FIG. 8*b* shows an oval (form of a race-track) or an ellipse-like cross-sectional form of the upper shank section 25. The abutment sites 60 are provided in the region of the main vertices. In the region of the ancillary vertices, the oval or ellipse is flattened, so that the upper shank section 25 has plane outside surface sections 67 on two opposing sides in the region of the ancillary vertices, said outside surface sections representing the recesses 65 between the two abutment sites 60.

Figure 8C:
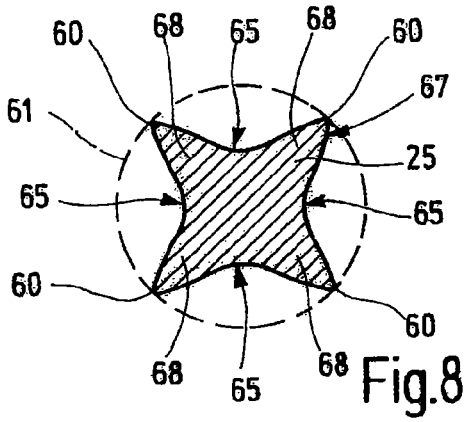
Figure 8D:
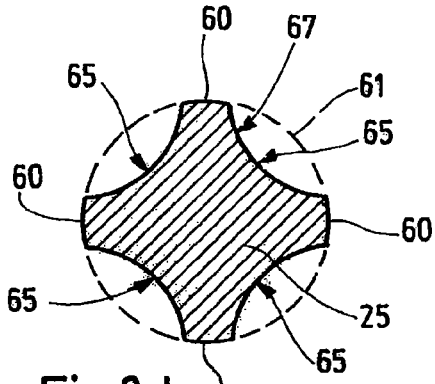

Alternatively, the cross-section of the upper shank section 25 may also have the contour of a star or a cross, as is obvious, for example, from FIGS. 8*c* and 8*d*. The star-like cross-sectional contour has several star points 68, whereby the abutment sites 60 are formed on their radially outermost ends. The recesses 65 are provided between two adjacent star points 68. Considering the exemplary embodiment in accordance with FIG. 8*c*, the star-shaped cross-sectional contour of the upper shank section 25 comprises star points 68 that are uniformly distributed over the circumference, said points extending outward from a central region about the longitudinal axis 16 and, in so doing, tapering toward their radially outermost end. At this radially outermost end, the star points 68 are rounded, so that, preferably, no sharp edges are formed on the abutment sites 60. The outside surface section 67 of the recess 65 is curved concavely inward in a V-like manner. The transition between the star points 68 is without edge. By modifying the illustrated embodiment, it is also possible to provide more than four star points 68.

Considering the cruciform cross-section of FIG. 8*d*, the abutment sites 60 are curved convexly outward in radial direction, whereby the curvature has, in particular, the same radius as the lateral cylinder surface 61. The recesses 65 between the abutment sites 60 are formed by the concavely curved outside surface sections 67 of the upper shank section 25, said outside surface sections displaying an arcuate shape viewed in cross-section of the upper shank section 25.

Figure 8E:
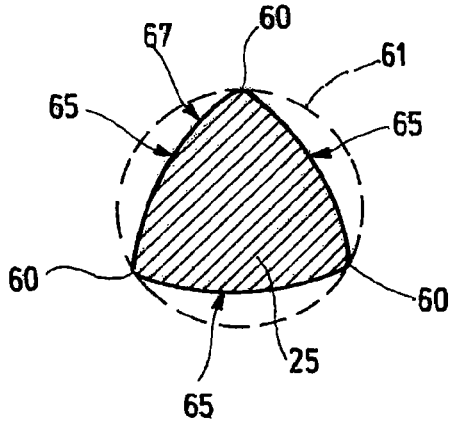
Figure 8F:
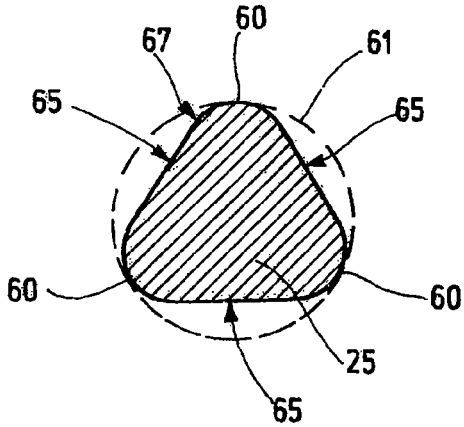

The two cross-sectional forms in accordance with FIGS. 8*e* and 8*f* provide a triangle-like cross-sectional form for the upper shank section 25. In the exemplary embodiment in accordance with FIG. 6*e*, the three outside surface sections 67 of the upper shank section 25 are convexly curved outward. The points of the triangle are also provided with a radius, so that the entire outside surface of the upper shank section 25 is configured without sharp edges and corners. The points represent the abutment sites 60 and are located on the common lateral cylinder surface 61. The curved outside surface sections 67 between the abutment sites 60 represent the recesses 65.

Considering the triangle-like cross-sectional form shown in FIG. 8*f*, the recesses 65 are represented by three plane outside surface sections 67 of the upper shank section 25, said outside surface sections being distributed over the circumference in a regular manner. Viewed in circumferential direction, the abutment sites 60 are provided between these plane outside surfaces, said abutment surfaces being curved outward, for example, with a radius. The radius of the abutment sites 60 has a maximum size that is as large as the radius of the lateral cylinder surface 61 and—in the preferred exemplary embodiment according to FIG. 8*f*—is smaller than the radius of the common lateral cylinder surface 61.

The described exemplary embodiments of the cross-sectional form of the upper shank section 25 may deviate from the preferred embodiments shown in FIGS. 8*a* through 8*f*. For example, the corners and edges of a polygonal cross-section may be curved or provided with radii, so that an external outside surface of the upper shank section 25 without corners and edges is achieved. In all exemplary embodiments, the symmetry of the cross-sectional form of the upper shank section 25 is selected in such a manner that the center of gravity of the upper shank section 25 is located on the longitudinal axis 16.

Figure 3:
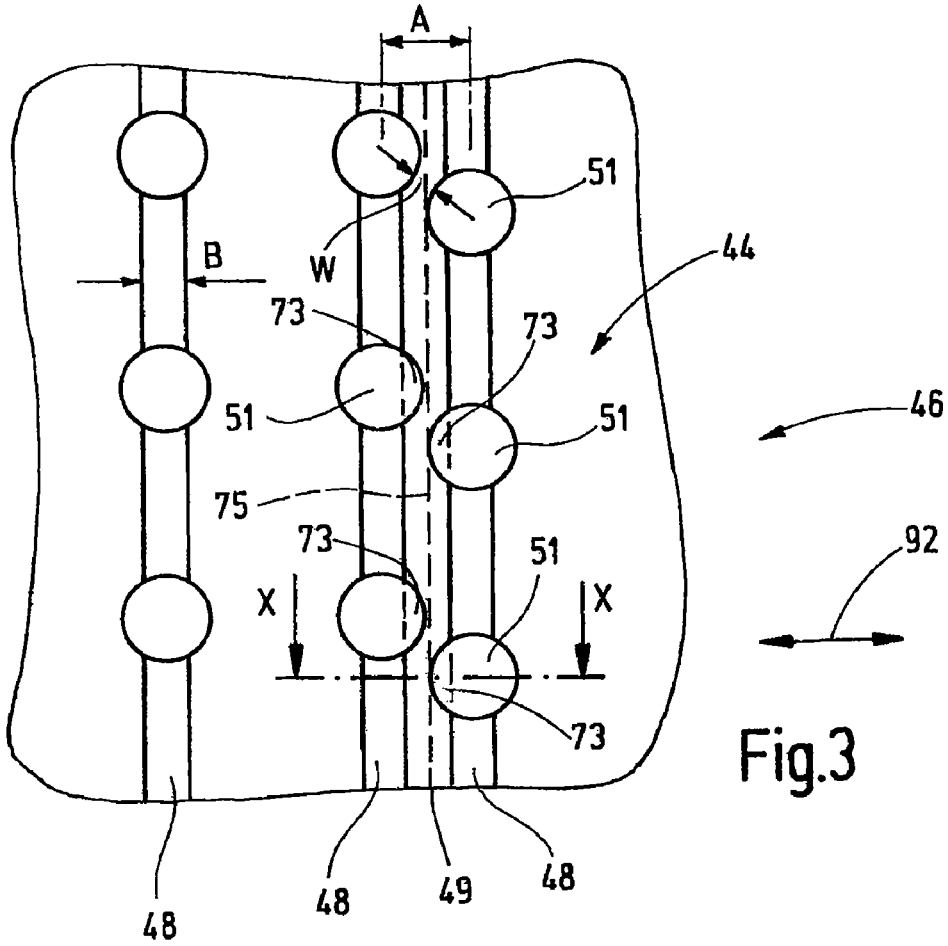
FIG. 3 is a schematic illustration of a detail of a needle board of a needle holder, in plan view of said needle board.
Figure 4:
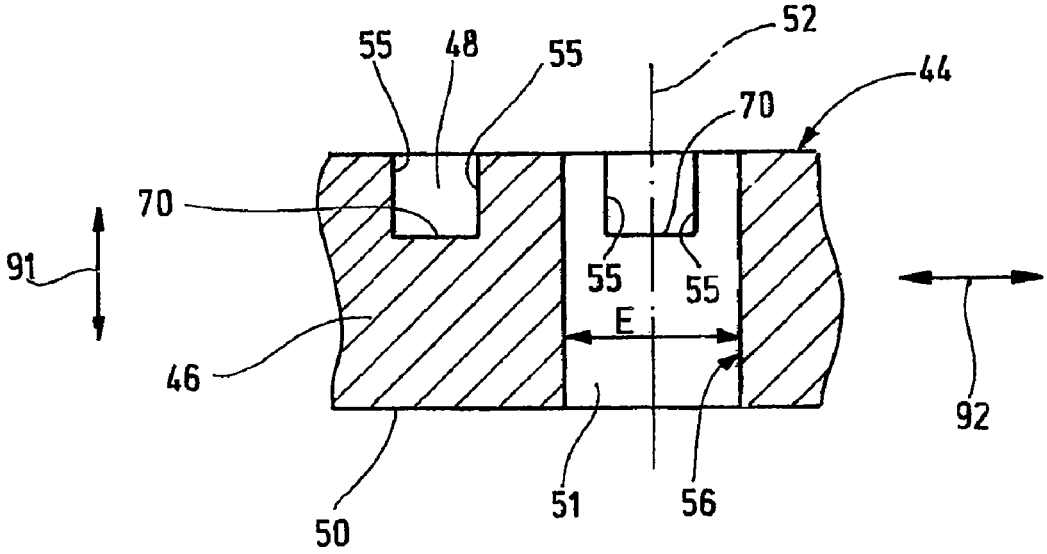
FIG. 4 is a sectional view, along section line IV-IV, of a detail of the needle board in accordance with FIG. 3.

FIGS. 3 and 4 are schematic views of the needle board 46 of the needle holder 45.

In the description hereinafter it is assumed, for example, that a needle board is arranged above the planar textile material that is to be processed. Basically, such a needle board may, additionally or alternatively, also be arranged below the planar textile material.

The needle holder 45 comprises a needle board 46 and a needle bar 47. Grooves 48 are provided in the needle board 46, said grooves being open toward an upper side 44 and extending—parallel to each other—at a distance from each other in one direction. The grooves 48 have oppositely arranged groove flanks 55 adjacent to the grooves' open side, said flanks delimiting the groove 48 in groove width direction 92, said width direction corresponding to the width direction 34 of the needle 15 with the needle inserted in the needle board 46. The two groove flanks 55 are connected to each other via a groove base 70.

Two adjacent grooves 48 are separated by a distance in the form of a strip 49. A plurality of bores 51 extend from the upper side 44 to an opposite underside 50 through the needle board 46. In the region of the upper side 44, the bores 51 terminate in the grooves 48. The central axis 52 of the bores extends—approximately centered—through the respective groove 48 in groove width direction 92. Several bores 51 are provided along each groove 48.

In the preferred embodiment of the needle board 46, the bores 51 that are connected by a common groove 48 are arranged at regular distances—viewed in the direction of extension of the grove 48. The bores 51 of two adjacent grooves may be arranged offset relative to each other—viewed in the direction of extension of the grooves, as is the case with the two grooves 48 shown on the right in the illustration of FIG. 3, for example. In so doing, the central axes 52 of the bores 51 of a groove 48 are arranged at a distance from the central axes 52 of the bores 51 of the respectively other groove 48.

The groove width B is measured transversely with respect to the transverse direction 31 in width direction 34. The groove width B may change as a function of the viewed point on the groove flank 55 or on the groove base 48. Whereas, considering the rectangular groove cross-section in accordance with FIG. 4, the groove width B of a groove 48 has the same value at each point of the groove, the groove width B in the cross-sectional forms of groove 48 suggested in FIGS. 5*a* through 5*f* is a function of the location of the point where the groove width B is measured—viewed in a depth direction 91 of the groove 48 parallel to the direction of the central axes 52 of the bores. At least the groove width B in the region of the groove base 70 is smaller than the diameter E of the upper shank section 25 or of the bores 51. Alternatively or additionally, the mean value of the groove width B of a groove 48 is also smaller than the diameter E of the bores 51. In particular in conjunction with the bores 51 arranged offset relative to the transverse direction 31 of the grooves 48, the respectively adjacent grooves 48 may be arranged very closely next to each other, and a high needle density in the needle board 46 may be achieved. Considering a preferred cross-sectional form of the groove 48, the mean value of the groove width B is at most as large as half the diameter E of the upper shank section 25 or of the bore 51.

As is obvious from FIG. 3, the strips 49 have—in the region of each bore 51 of a groove 48 adjacent to the strip 49—a cutout 73 having the form of a cylinder section. The width of the strip 49—viewed in width direction 34—or its wall thickness W, changes as a function of the point viewed in transverse direction 31. In so doing, the wall thickness W of the strip 49 is measured at a right angle relative to a tangent that is applied at the viewed point to the groove flank delimiting said strip 49. In the preferred exemplary embodiment of the needle board 46, the minimum wall thickness W of a strip 49 occurs in the region of the cutouts 73.

A groove distance A between the groove center in the groove width direction 92 of one of the grooves 48 and the groove center of a groove 48 directly adjacent thereto is at most as large as the diameter E of the bores 51 provided in the needle board 46. In other words: If the tangent 75 were applied—between these two grooves 48 in the direction of extension of the grooves 48—to the bores 51 of one of the grooves 48, said tangent would also represent the tangent on the bores 51 of the respectively other groove 48 or intersect said bores. A groove distance A selected in such a manner between two adjacent grooves 48 is preferably only provided on some of the grooves 48 of the groove board 46. Other, directly adjacent grooves 48 display a greater groove distance A. The groove distances A between a groove 48 and the two grooves 48 extending directly adjacent thereto may have different dimensions.

The groove cross-section may be different from its rectangular form shown in FIG. 4, as is schematically indicated for example in FIGS. 5*a* through 5*f*. As a result of this, it is possible to change the cross-section of the strip 49 between the two grooves 48 accordingly; as a result of this, said strip can be imparted with sufficiently high stability, on the one hand, and the cross-sectional form of the groove may be adapted to the cross-sectional contour of the holding means 32 of the needle 15, on the other hand.

Considering all the cross-sectional forms of the groove 48, the groove width B in the transition region between the groove flanks 55 and the groove base 70 is smaller than the diameter of the bore 51. Also, the mean value of the groove width B, which may change as a function of the viewed site on the groove flanks 55 or the groove base 70, is smaller than the diameter of the bore 51. In so doing, the groove width B may—at any point—be smaller than the diameter of the bore 51, as is the case with the groove diameters in accordance with FIGS. 5*a*, 5*b*, 5*d* and 5*f*. Considering the two other modifications of the groove cross-sections of FIGS. 5*c* and 5*e*, the maximum groove width B just corresponds to the diameter E of the bore 51.

Figure 5A:
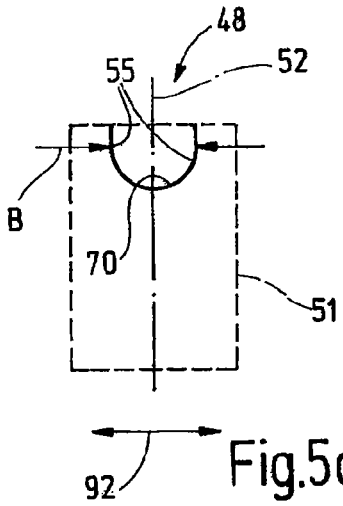
FIGS. 5*a* through 5*f* are various cross-sectional forms of the groove of the needle board.

In FIG. 5*a* the cross-section of the groove is U-shaped with a channel-like groove base 70. The two groove flanks 55 are aligned parallel to the direction of the central axis of bore 51. A form, that is a modification thereof, is shown in FIG. 5*f*, where the groove base 70 consists of two surface sections 70*a*, 70*b*. Each of the two surface sections 70*a*, 70*b* is inclined with respect to the central axis 52, or with respect to the groove depth direction 91. The angle of inclination is approximately 60°, for example. In the center of the groove, the two surface sections 70*a*, 70*b* abut against each other while forming an edge along the entire groove 48 and subtending the double angle of inclination.

Figure 5B:
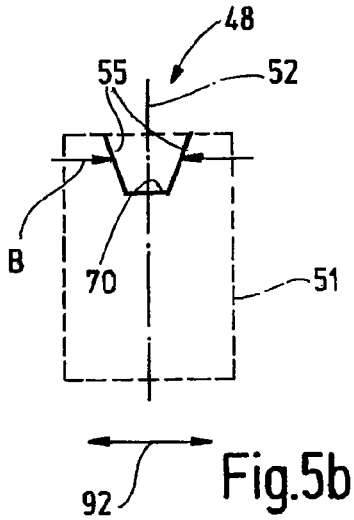
Figure 5C:
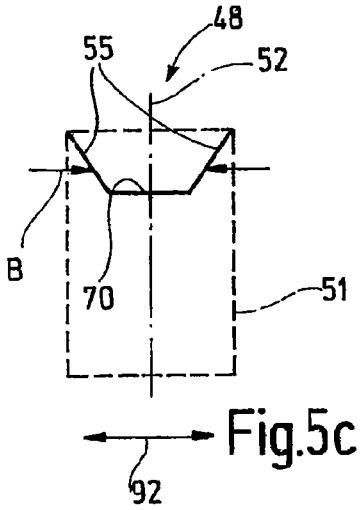

FIGS. 5*b* and 5*c* show another groove shape having a trapezoidal cross-section, whereby the groove base 70 extends transversely to the central axis 52 in width direction 34. The two groove flanks 55 are inclined relative to the central axis 52 of the bore 51. In accordance with FIG. 5*c*, the width B of the groove 48 on the upper side 44 of the needle board 46 corresponds to the diameter of the bore 51. Inasmuch as the two groove flanks 55, extending from the upper side 44 of the needle board 46, are arranged so as to be inclined in the direction of the central axis 52 of the bore 51, the mean width of the groove 48 is smaller than the diameter of the bore 51.

Figure 5D:
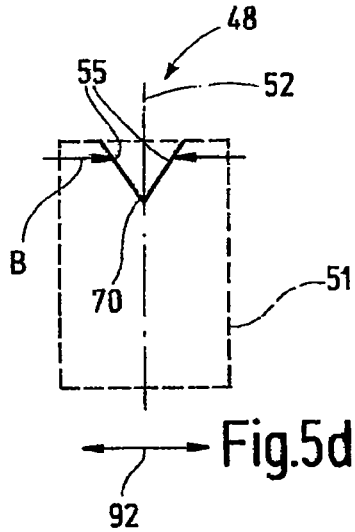
Figure 5E:
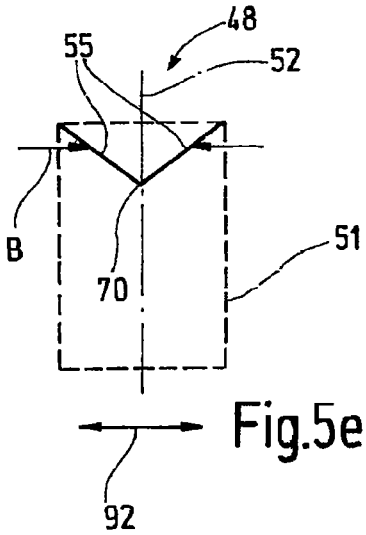
Figure 5F:
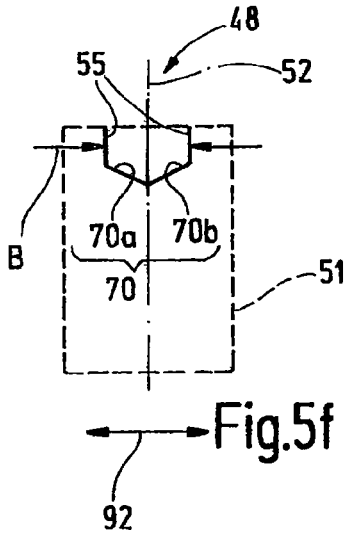

FIGS. 5*d* and 5*e* show triangular groove cross-sections, whereby the groove base 70 is formed by an edge in the transition region of the two groove flanks 55, said edge extending in the direction of the extension of the groove 48. The groove flanks 55 are arranged in a V-shape relative to each other and form an acute angle.

The angle between the groove base 70 and the groove flanks 55 may a trapezoidal groove cross-section in the range of from 45° to 85°. The angle subtended by the two groove flanks 55 at the groove base 70 may vary—considering a triangle-shaped groove cross-section—in the range between 70° and 130°.

In addition to the forms of the groove 48 shown in FIGS. 5*a* through 5*f*, forms different therefrom are possible. For example, the groove 48 may also have the form of a swallow tail. The cross-section of the groove 48 may be congruent to the cross-section of the holding means 32.

Considering the preferred embodiment, the needle board 46 may be made of a non-elastic material, preferably of metal. The grooves 48 may be applied to a metal plate in a simple manner by milling. The bores 51 may be applied previously or subsequently.

In this case, the needle holder 45 is provided for a not specifically illustrated felting machine. In so doing, the needle board 46 is arranged essentially in a horizontal manner. A needle 15 is inserted through each bore 51, so that the upper shank section 25 abuts with its abutment sites 60 against the inside surface of the respective bore 51, said bore representing a counter abutment surface 56 for the abutment sites 60. As a result of this, the needle 15 is arranged so as to be supported radially with respect to its longitudinal axis 16 in the needle board 46. Inasmuch as the working sections 17 of the needles need not always be configured symmetrically with respect to the longitudinal axis 16, a desired rotational position about the longitudinal axis 16 is accomplished, said position to be taken by the needles 15 in the needle holder 45. In order to prespecify this rotational position and to also maintain it during the felting operation, the holding means 32 of the needle foot 30 of the needles 15 is arranged in the groove 48, said groove extending—in the region of the upper side 44—through the bore 51 in which the respective needle 15 is located. In so doing, the groove flanks 55 of the groove 48 act, as it were, as a rotating abutment for the holding means 32, so that the needle 15 is not able to rotate about its longitudinal axis 16 or is able to only rotate, corresponding to the play between the holding means 32 and the groove flanks 55, about its longitudinal axis 16. Preferably, the holding means 32—viewed in operative position of the needle 15 in width direction 34—is arranged without play in the groove 48.

During the felting process, the working direction is aligned parallel to the longitudinal axis 16 of the needles 15. The needle bar 46 is placed on the upper side 44 of the needle board 46, so that the needles 15—in working direction—are fixated parallel to the longitudinal axis 16, as can be schematically seen in FIGS. 1 and 2. During the felting process, the needle holder 45 with the needles 15 held in it moves up and down in working direction and processes the textile material that is arranged on a not specifically illustrated support.

The invention relates to a needle holder 45 for a textile machine comprising a needle board 46, in which are provided—on an upper side 44—several grooves 48 extending parallel to each other. Arranged along each groove 48, there are several bores 51 at a distance from each other and completely extending through the needle board 46. The diameter E of the bores 51 is greater than a mean value of the groove width B or greater than the groove width B in the region of the groove base 70.

It will be appreciated that the above description of the present invention is susceptible to various modifications, changes and modifications, and the same are intended to be comprehended within the meaning and range of equivalents of the appended claims.

LIST OF REFERENCE NUMERALS

15 Needle
16 Longitudinal axis
17 Working section
18 Needle point
20 Lower shank section
21 First transition region
25 Upper shank section
26 First step, annular surface
30 Needle foot
31 Transverse direction
32 Holding means
33 Foot connection
34 Width direction
35 Free end of 32
35' Free end of 32
40 Second step
41 Second transition region
42 Third transition region
44 Upper side of 46
45 Needle holder
46 Needle board
47 Needle bar
48 Groove
49 Strip
50 Underside of 46
51 Bore
52 Central axis of 51
55 Groove flank
56 Counter-abutment surface
60 Abutment site
61 Lateral cylinder surface
65 Recess
67 Outside surface section
68 Star point
70 Groove base
70*a* Surface section of 70
70*b* Surface section of 70
73 Cutout
75 Tangent
91 Depth direction
92 Groove width direction
A Groove distance
B Groove width
C Diameter of 17
D Diameter of 20
E Diameter of 25, 51
W Wall thickness

What is claimed is:

1. A needle holder for a textile machine, the needle holder comprising:

a needle board, in which are provided, on one upper side, at least two grooves extending parallel to each other in a transverse direction, the at least two grooves having groove widths, whereby, along individual ones of the at least two grooves at least two bores are provided at a distance from each other within the groove and completely extending through the needle board from the upper side to an opposite underside, whereby a diameter of individual ones of the at least two bores along a given groove is greater than a mean value of a groove width of the given groove or greater than the groove width of the given groove in a region of a groove base for the individual ones of the at least two bores.

2. The needle holder in accordance with claim 1, wherein the bores of two adjacent grooves are arranged so as to be offset relative to each other in the transverse direction.

3. The needle holder in accordance with claim 1, wherein a groove distance in width direction (34) transverse to the transverse direction (31) between a groove center of one of the grooves and a groove center of one of the grooves (48) extending directly adjacent thereto is at most as large as the diameter of the bores of those grooves.

4. The needle holder in accordance with claim 3, wherein the groove distances between the groove center of one groove and the groove centers of the two grooves extending directly adjacent thereto have different dimensions.

5. The needle holder in accordance with claim 1, wherein the mean value of the groove width is at most half the diameter of the bore.

6. The needle holder in accordance with claim 1, further comprising at least one strip between each two adjacent grooves, said strip having a cutout in the region of the bores.

7. The needle holder in accordance with claim 6, wherein a minimum wall thickness of the strip occurs in the region of the cutout.

8. The needle holder in accordance with claim 1, wherein the grooves have a cross-sectional form that is different from a rectangular form.

9. The needle holder in accordance with claim 1, wherein the groove width increases from the groove base toward the upper side of the needle board.

10. The needle holder in accordance with claim 1, wherein the groove base comprises at least two plane surface sections that abut against each other while forming an edge.

11. The needle holder in accordance with claim 1, wherein the grooves have a trapezoidal cross-section.

12. The needle holder in accordance with claim 1, wherein the grooves have a triangle-shaped cross-section.

13. The needle holder in accordance with claim 1, wherein the grooves have a U-shaped cross-section.

14. The needle holder in accordance with claim 1, wherein the needle board is made of a non-elastic material.

15. The needle holder of claim 1, further comprising a needle comprising:

a working section extending along a longitudinal axis and having a needle point;

a lower shank section adjoining the working section, an upper shank section adjoining said lower shank section, whereby both shank sections extend coaxially with respect to each other along the longitudinal axis, a needle foot adjoining the upper shank section, said needle foot having a holding means extending in the transverse direction transversely with respect to the longitudinal axis in an essentially straight line;

whereby an upper shank section diameter is both greater than a lower shank section diameter and greater than a mean width of the holding means of the needle foot in a width direction.

* * * * *